US009293244B2

(12) United States Patent
Matsuura et al.

(10) Patent No.: US 9,293,244 B2
(45) **Date of Patent: *Mar. 22, 2016**

(54) MAGNETIC MATERIAL AND COIL COMPONENT USING THE SAME

(75) Inventors: Hitoshi Matsuura, Takasaki (JP); Hideki Ogawa, Takasaki (JP); Atsushi Tanada, Takasaki (JP); Kiyoshi Tanaka, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 917 days.

This patent is subject to a terminal disclaimer.

(21) Appl. No.: 13/546,911

(22) Filed: Jul. 11, 2012

(65) Prior Publication Data

US 2013/0176098 A1 Jul. 11, 2013

(30) Foreign Application Priority Data

Jul. 19, 2011 (JP) ..... 2011-158437

(51) Int. Cl.

| | |
|---|---|
| ***H01F 27/255*** | (2006.01) |
| ***H01F 1/01*** | (2006.01) |
| ***H01F 41/02*** | (2006.01) |
| ***H01F 1/147*** | (2006.01) |
| ***H01F 1/33*** | (2006.01) |

(52) U.S. Cl.

CPC ..... *H01F 27/255* (2013.01); *H01F 1/01* (2013.01); *H01F 1/14766* (2013.01); *H01F 1/33* (2013.01); *H01F 41/0246* (2013.01)

(58) Field of Classification Search

CPC ..... B22F 1/02; B22F 9/082; H01F 1/24; H01F 1/14766; C23C 8/10

See application file for complete search history.

(56) References Cited

U.S. PATENT DOCUMENTS

| | | | | |
|---|---|---|---|---|
| 6,784,782 | B2 | 8/2004 | Inoue et al. | |
| 7,270,718 | B2 * | 9/2007 | Nishijima et al. | 148/105 |
| 8,416,051 | B2 * | 4/2013 | Matsuura et al. | 336/233 |
| 2008/0029300 | A1 | 2/2008 | Harada et al. | |

(Continued)

FOREIGN PATENT DOCUMENTS

| | | | |
|---|---|---|---|
| JP | H09-074011 | A | 3/1997 |
| JP | 2000-030925 | A | 1/2000 |

(Continued)

OTHER PUBLICATIONS

Machine translation of JP2010-272604 A, Dec. 2010.*

(Continued)

*Primary Examiner* — Jie Yang
*Assistant Examiner* — Xiaowei Su
(74) *Attorney, Agent, or Firm* — Law Office of Katsuhiro Arai

(57) ABSTRACT

A magnetic material constituted by a grain compact 1 obtained by shaping metal grains 11 and then heat-treating them in an oxidizing ambience, wherein the metal grains 11 are made of a Fe—Cr—Si alloy and their $Fe_{Metal}/(Fe_{Metal}+Fe_{Oxide})$ ratio as measured before shaping by XPS, with respect to the sum of integral values at the peaks of 709.6 eV, 710.7 eV and 710.9 eV, or $Fe_{Oxide}$, and peak integral value at 706.9 eV, or $Fe_{Metal}$, is 0.2 or more.

8 Claims, 1 Drawing Sheet

(56) References Cited

U.S. PATENT DOCUMENTS

| | | | | |
|---|---|---|---|---|
| 2009/0110587 | A1* | 4/2009 | Aramaki et al. | 419/10 |
| 2011/0024670 | A1 | 2/2011 | Otsuki et al. | |
| 2011/0267167 | A1 | 11/2011 | Ogawa et al. | |
| 2012/0038449 | A1 | 2/2012 | Ogawa et al. | |

FOREIGN PATENT DOCUMENTS

| | | | | |
|---|---|---|---|---|
| JP | 2001-011563 | A | | 1/2001 |
| JP | 2001-118725 | A | | 4/2001 |
| JP | 2002-305108 | A | | 10/2002 |
| JP | 2002-313620 | A | | 10/2002 |
| JP | 2002-343618 | A | | 11/2002 |
| JP | 2007-019134 | A | | 1/2007 |
| JP | 2007-027354 | A | | 2/2007 |
| JP | 2007-123703 | A | | 5/2007 |
| JP | 2007-299871 | A | | 11/2007 |
| JP | 2008-028162 | A | | 2/2008 |
| JP | 2008-041961 | A | | 2/2008 |
| JP | 2008-195986 | A | | 8/2008 |
| JP | 2008240041 | A | * | 10/2008 |
| JP | 2009-088496 | A | | 4/2009 |
| JP | 2009-088502 | A | | 4/2009 |
| JP | 2010272604 | A | * | 12/2010 |
| JP | 2011-249774 | A | | 12/2011 |
| WO | 2009/128425 | A1 | | 10/2009 |

OTHER PUBLICATIONS

Machine translation of JP2008-240041 A, Oct. 2008.*
Machine translation of JP 2007-299871A. Nov. 2007.*

* cited by examiner

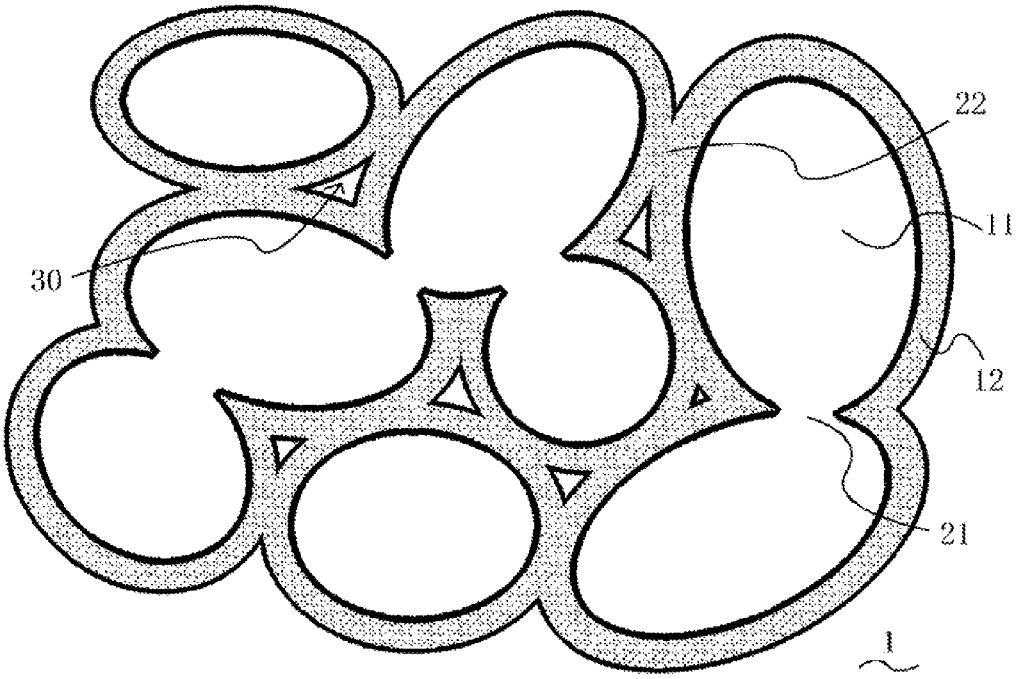
22
11
30
12
21
1

MAGNETIC MATERIAL AND COIL COMPONENT USING THE SAME

BACKGROUND

1. Field of the Invention

The present invention relates to a magnetic material that can be used primarily as the cores of coils, inductors, etc., as well as a coil component using such material.

2. Description of the Related Art

Coil components such as inductors, choke coils and transformers (hereinafter referred to as "inductance components") have a magnetic material, and a coil formed inside or on the surface of the magnetic material. Generally used magnetic materials include Ni—Cu—Zn ferrite and other ferrites.

Coil components of this type are required to offer an electrical current amplification (higher rated current) in recent years, and switching the magnetic material from a conventional ferrite to Fe—Cr—Si alloy is being examined to meet this requirement (refer to Patent Literature 1). Fe—Cr—Si and Fe—Al—Si alloys are materials offering a higher saturated magnetic flux density than ferrites do. On the other hand, these alloy materials have a significantly lower volume resistivity than conventional ferrites.

Patent Literature 1 discloses a method for producing the magnetic material part of a stacked coil component, wherein the specific method is to stack a magnetic layer formed with a magnetic paste containing Fe—Cr—Si alloy grains and glass component, with a conductive pattern, and sinter the stack in a nitrogen ambience (reducing ambience), and then impregnate a thermosetting resin in the sintered stack.

PATENT LITERATURE

[Patent Literature 1] Japanese Patent Laid-open No. 2007-027354

SUMMARY

However, the sintered stack obtained by the manufacturing method in Patent Literature 1 does not necessarily offer a high magnetic permeability. Also, while powder magnetic cores shaped from a binder-containing mixture are known for use with inductors comprising metal magnetic materials, it cannot be said that common powder magnetic cores offer high insulation resistance.

In consideration of the above, the object of the present invention is to provide a new magnetic material offering a higher magnetic permeability, or preferably both a high magnetic permeability and high insulation resistance, as well as a metal powder that can be used as a material for such magnetic material, and also provide a coil component using such magnetic material.

After studying in earnest, the inventors completed the present invention described below.

A magnetic material according to the present invention is constituted by a grain compact obtained by shaping metal grains and then heat-treating them in an oxidizing ambience, wherein the metal grains are made of a Fe—Cr—Si alloy and their $Fe_{Metal}/(Fe_{Metal}+Fe_{Oxide})$ ratio as measured before shaping by XPS, with respect to the sum of integral values at the peaks of 709.6 eV, 710.7 eV and 710.9 eV, or $Fe_{Oxide}$, and peak integral value at 706.9 eV, or $Fe_{Metal}$, is 0.2 or more.

Preferably the Cr content in the grain compact is 2.0 to 15 percent by weight.

Also, the grain size distribution of metal grains before shaping, based on volume, is preferably such that d10/d50 is 0.1 to 0.7 and d90/d50 is 1.4 to 5.0.

According to another favorable embodiment, the tap density of metal grains before shaping, as specified in the JIS Z 2512: 2006 standard, is 3.8 g/cm$^3$ or more.

A metal powder made of the aforementioned Fe—Cr—Si alloy whose $Fe_{Metal}/(Fe_{Metal}+Fe_{Oxide})$ ratio as measured by XPS, with respect to the sum of integral values at the peaks of 709.6 eV, 710.7 eV and 710.9 eV, or $Fe_{Oxide}$, and peak integral value at 706.9 eV, or $Fe_{Metal}$, is 0.2 or more, is also an embodiment of the present invention.

According to the present invention, a coil component having the aforementioned magnetic material, and a coil formed inside or on the surface of the magnetic material, is also provided.

According to the present invention, a magnetic material of high magnetic permeability is provided. In a favorable embodiment of the present invention, a magnetic material offering both a high magnetic permeability and high insulation resistance is provided.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

The FIGURE is a schematic section view showing the detailed structure of a magnetic material conforming to the present invention.

DESCRIPTION OF THE SYMBOLS

1: Grain compact,
11: Metal grain,
12: Oxide film,
21: Metal bonds,
22: Oxide film bonds,
30: Void

DETAILED DESCRIPTION

The present invention is described by referring to the drawing as deemed appropriate. It should be noted, however, that the present invention is not at all limited to the embodiment illustrated, and that, because characteristic parts of the invention may be exaggerated in the drawing, the scale of each part of the drawing is not necessarily accurate.

A magnetic material according to the present invention is constituted by a grain compact made by shaping specified grains.

Under the present invention, the magnetic material plays the role of a magnetic path in a coil, inductor or other magnetic component, and typically takes the form of a core of a coil, etc.

The FIGURE is a schematic section view showing the detailed structure of a magnetic material conforming to the present invention. Under the present invention, the grain compact 1 is understood, microscopically, as an assembly of many metal grains 11 that were originally independent but are now bonded together, where individual metal grains 11 have an oxide film 12 formed virtually all around their periphery and this oxide film 12 ensures insulation property of the grain compact 1. Adjacent metal grains 11 constitute the grain compact 1 having a specified shape by means of bonding of oxide films 12 around the respective metal grains 11. Metal parts of adjacent metal grains 11 may be bonded in some areas. Conventional magnetic materials use a matrix of hardened organic resin containing magnetic grains or several or so magnetic grain bonds dispersed in it, or a matrix of hardened glass component containing magnetic grains or several or so magnetic grain bonds dispersed in it. Under the present invention, preferably there is virtually no matrix of organic resin or matrix of glass component.

Individual metal grains 11 are made of a Fe—Cr—Si alloy and exhibit soft magnetism. The Si content in the Fe—Cr—Si soft magnetic alloy is preferably 0.5 to 7.0 percent by weight, or more preferably 2.0 to 5.0 percent by weight. A high Si content is preferred in that it results in a high resistance/high magnetic permeability, but a low Si content leads to good shaping property, and the preferable ranges mentioned above are proposed in consideration of both.

The Cr content in the Fe—Cr—Si alloy is preferably 2.0 to 15 percent by weight, or more preferably 3.0 to 6.0 percent by weight. Presence of chromium lowers the magnetic characteristics before heat treatment, representing the physical properties of the material grain, but it suppresses excessive oxidization during heat treatment. Accordingly, more Cr increases the magnetic permeability due to heat treatment, while lowering the specific resistance after heat treatment. The preferable ranges mentioned above are proposed in Consideration of both.

It should be noted that the above preferable contents of each metal component of the Fe—Cr—Si alloy assume that the total amount of all alloy components gives 100 percent by weight. In other words, composition of oxide film is excluded in the calculations of the above preferable contents.

In the Fe—Cr—Si alloy, the remainder exclusive of Si and Cr is preferably iron, except for unavoidable impurities. Metals that may be contained other than Fe, Si and Cr include aluminum, magnesium, calcium, titanium, manganese, cobalt, nickel and copper, while examples of allowable nonmetals include phosphorous, sulfur and carbon.

The chemical composition of the alloy constituting each metal grain 11 of the grain compact 1 can be calculated by, for example, capturing the section of the grain compact 1 with a scanning electron microscope (SEM) and then conducting an energy dispersive X-ray spectroscopy (EDS) and calculating the composition using the ZAF method.

The magnetic material proposed by the present invention can be manufactured by shaping metal grains made of the specific alloy mentioned above and then heat-treating the shaped metal grains. Here, preferably heat treatment is applied in such a way that, in addition to the oxide film already present on the material metal grain, portions of metal of the material metal grain are also oxidized to form a metal oxide film 12.

For the material metal grain (hereinafter also referred to as "material grain"), primarily a grain made of a Fe—Cr—Si alloy is used. The alloy composition of the material grain is reflected in the alloy composition of the magnetic material to be finally obtained. Accordingly, a desired alloy composition can be selected for the material grain as deemed necessary according to the target alloy composition of the magnetic material to be finally obtained, where the preferable range of compositions of the material grain is the same as the preferable range of compositions of the magnetic material. Individual material grains may be covered with an oxide film. In other words, individual material grains may be constituted by a core made of a specified soft magnetic alloy, and an oxide film covering around the core at least partially.

Examples of the material grain include grains manufactured by the atomization method. As mentioned above, preferably the material grain has an oxide film because the grain compact 1 has bonds 22 via oxide film 12.

The composition ratio of the core made of an alloy and oxide film in the material grain can be quantified as follows. The material grain is analyzed by XPS and, by focusing on the peak intensity of Fe, the integral value at the peak (706.9 eV) where Fe is present in a metal state, or $Fe_{Metal}$, and integral value at the peak where Fe is present as an oxide, or $Fe_{Oxide}$, are obtained and then $Fe_{Metal}/(Fe_{Metal}+Fe_{Oxide})$ is calculated to quantify the aforementioned ratio. Here, calculations of $Fe_{Oxide}$ use fitting with measured data, by overlaying a normal distribution of data, primarily bonding energies of three types of oxides including $Fe_2O_3$ (710.9 eV), FeO (709.6 eV) and $Fe_3O_4$ (710.7 eV). As a result, $Fe_{Oxide}$ is calculated as a sum of integral areas of isolated peaks. Since facilitating the formation of metal bonds 21 among alloys during heat treatment improves the magnetic permeability, the aforementioned value is preferably 0.2 or more. No specific upper limit is set for the aforementioned value, but from the viewpoint of ease of manufacturing, an upper limit of 0.6, or preferably 0.3, may be set, for example. Means for raising the aforementioned value include applying heat treatment in a reducing ambience, or applying a chemical treatment such as eliminating the surface oxide layer using an acid, for example. The reduction treatment may be implemented by, for example, holding the grains in an ambience of nitrogen or argon containing 25 to 35% of hydrogen, at a temperature of 750 to 850° C., for 0.5 to 1.5 hours. The oxidization treatment may be implemented by, for example, holding the grains in air, at a temperature of 400 to 600°, for 0.5 to 1.5 hours.

The aforementioned material grain may be produced by any known alloy grain manufacturing method, or any commercial product such as PF20-F by Epson Atmix or SFR—FeSiCr by Nippon Atomized Metal Powders may be used. Since the value of $Fe_{Metal}/(Fe_{Metal}+Fe_{Oxide})$ mentioned above is not a known parameter in commercial products, it is preferable to screen material grains or apply the aforementioned heat treatment or chemical treatment beforehand when a commercial product is used. From this viewpoint, a manufacturing method for metal material that involves calculation of the aforementioned value of $Fe_{Metal}/(Fe_{Metal}+Fe_{Oxide})$ of Fe—Cr—Si alloy metal grains via XPS analysis, implementation of an acid treatment or heat treatment in a reducing ambience to the metal grains to bring the values to within a pre-defined range if the value calculated above is not within a pre-defined range, and shaping of the metal grains and applying heat treatment in an oxidizing ambience, when the above value is within a pre-defined range, to obtain a grain compact, is also included in the present invention. Here, the pre-defined range of the above value can take the preferable value mentioned above, for example.

According to an embodiment of the present invention, a metal powder made of a Fe—Cr—Si alloy whose $Fe_{Metal}/(Fe_{Metal}+Fe_{Oxide})$ value mentioned above is within the aforementioned range is provided. Here, the term "metal powder" does not mean an assembly of metal grains compacted to a specified shape, but it means an assembly of metal grains where individual metal grains can flow freely.

The sizes of individual material grains are virtually the same as the size of the grain constituting the grain compact 1 of the magnetic material to be finally obtained. When the magnetic permeability and in-grain eddy current loss are considered, the material grain size is such that d50 is preferably 2 to 30 μm, or more preferably 2 to 20 μm, or even more preferably 3 to 13 μm. In addition, d10 is preferably 1 to 5 μm, or more preferably 2 to 5 μm. Also, d90 is preferably 4 to 30 μm, or more preferably 4 to 27 μm. Moreover, d10/d50 is preferably 0.1 to 0.7, or more preferably 0.2 to 0.6. Furthermore, d90/d50 is preferably 1.4 to 5.0, or more preferably 1.5 to 3.0. Values within the above ranges are preferred in that the eddy current loss is suppressed while the compact density increases. Here, d10/d50 and d90/d50 are rough guides indicating the expanse of grain size distribution. The closer the value of d10/d50 to 1, the narrower the grain size distribution becomes on the small grain size side, and the smaller the value of d10/d50, the wider the grain size distribution becomes on the small grain size side. The closer the value of d90/d50 to 1, the narrower the grain size distribution becomes on the large grain size side, and the greater the value of d90/d50, the wider the grain size distribution becomes on the large grain size side. All d10, d50 and d90 of the material grain are reference values of grain size distribution based on volume, which can be measured using a laser diffraction/scattering measurement apparatus.

The tap density of the material grain is preferably 3.8 g/cm$^3$ or more, or more preferably 3.8 to 5.7 g/cm$^3$, or even more preferably 4.0 to 4.8 cm$^3$. A high tap density is preferred as it increases the compact density. The tap density of the material grain can be obtained using the measurement method specified in the JIS Z 2512: 2006 standard, and specifically measured as described below.

According to the present invention, the compact 1 is obtained by shaping such material grains and applying heat treatment. Shaping and heat treatment are not specifically limited, and any known means used in grain compact manufacturing can be incorporated as deemed appropriate. The following explains a typical manufacturing method, which is to shape material grains under a non-heated condition and then apply heat treatment. The present invention is not at all limited to this manufacturing method.

When shaping material grains under a non-heated condition, it is desirable to add an organic resin as a binder. For the organic resin, use of an acrylic resin, butylal resin, vinyl resin or other resin having a thermal decomposition temperature of 500° or below is preferred because the binder will not likely remain after heat treatment. Any known lubricant may be added during shaping, where examples of lubricant include organic acid salts, or specifically zinc stearate and calcium stearate, among others. The amount of lubricant is preferably 0 to 1.5 parts by weight, or more preferably 0.1 to 1.0 parts by weight, relative to 100 parts by weight of material grains. When the amount of lubricant is zero, it means no lubricant is used. After adding a desired binder and/or lubricant to the material grains and agitating the mixture, the mixture is shaped to a specified shape. This shaping may be done by applying a pressure of 5 to 15 tons/cm$^2$, for example. In this stage, it is highly likely that neither oxide film bonds 22 nor metal bonds 21 is present.

A favorable mode of heat treatment is explained.

Preferably, heat treatment is performed in an oxidizing ambience. To be specific, the oxygen concentration during heating is preferably 1% or more, as this facilitates the formation of both oxide film bonds 22 and metal bonds 21. No specific upper limit is set for the oxygen concentration, but from the viewpoint of manufacturing cost, etc., an upper limit of oxygen concentration in air (approx. 21%) may be set. Preferably the heating conditions are set so that, in addition to the oxide film already present on the material grain before shaping, portions of metal of the material grain are also oxidized to form an oxide film 12. The heating temperature is preferably 600° or above to facilitate formation of oxide film 12 and consequently bonds via oxide film 12, and 900° or below to suppress oxidization to an appropriate level and maintain the presence of metal bonds 21 to increase the magnetic permeability. The heating temperature is more preferably 700 to 800°. To facilitate the formation of both oxide film bonds 22 and metal bonds 21, the heating time is preferably 0.5 to 3 hours.

The obtained grain compact 1 may have voids 30 inside. Voids 30 in the grain compact 1 may be at least partially impregnated with a polymer resin (not illustrated). Means for impregnating a polymer resin include, for example, soaking the grain compact 1 in a polymer resin in liquid state such as liquid polymer resin or polymer resin solution and then lowering the pressure of a manufacturing system, or applying the aforementioned polymer resin in liquid state to the grain compact 1 to let it infiltrate into voids 30 near the surface. Impregnating a polymer resin into voids 30 in the grain compact 1 offers the advantage of increasing strength and suppressing moisture absorption. To be specific, this makes it less easy for moisture to enter the grain compact 1 under high humidity in order to prevent the insulation resistance from dropping easily. Any polymer resin can be used without limitation, such as epoxy resin, fluororesin or any other organic resin, or silicone resin.

The grain compact 1 thus obtained has an oxide film 12 formed on individual metal grains 11. The oxide film 12 may be formed in the material grain stage before the grain compact 1 is formed, or it may be generated in the shaping process following the material grain stage where no or very little oxide film is present. Presence of the oxide film 12 can be recognized as a contrast (brightness) difference on a scanning electron microscope (SEM) image captured at around 3000 magnifications. Presence of the oxide film 12 ensures insulation property of the entire magnetic material.

The oxide film 12 needs only to be a metal oxide and preferably the oxide film 12 contains more chromium than iron in mol. One way to obtain an oxide film 12 of such composition is to select for the magnetic material a material grain containing as little iron oxide as possible or no iron oxide at all, and then oxidize the alloy surface via heat treatment, etc., in the process of obtaining the grain compact 1. Such treatment selectively oxidizes chromium and consequently the oxide film 12 will contain relatively more chromium than iron in mol. A higher content of chromium than iron in the oxide film 12 provides the advantage of suppressing excessive oxidization of alloy grains.

The method for measuring the chemical composition of the oxide film 12 of the grain compact 1 is explained below. First, the grain compact 1 is fractured or otherwise its section is exposed. Next, the section is smoothed by ion milling, etc., and the smoothed surface is captured with a scanning electron microscope (SEM), after which an energy dispersive X-ray spectroscopy (EDS) is conducted on the oxide film 12 and the composition is calculated using the ZAF method.

The chromium content in the oxide film 12 is preferably 1.0 to 5.0 mol, or more preferably 1.0 to 2.5 mol, or even more preferably 1.0 to 1.7 mol, relative to 1 mol of iron. A high chromium content is preferred in that it suppresses excessive oxidization, while a low chromium content is preferred in that it allows for sintering between metal grains. One way to decrease the chromium content is to apply heat treatment in a weak oxidization ambience, for example, while one way to increase the chromium content is to apply heat treatment in a strong oxidization ambience, for example.

In the grain compact 1, inter-grain bonds are primarily due to bonds 22 via oxide film 12 (bonds bonding oxide films to each other is referred to as "bonds via oxide film"). Presence of bonds 22 via oxide film 12 can be clearly determined by, for example, visually confirming on a SEM observation image taken at approx. 3000 magnifications the identicalness of phase between the oxide films 21 of adjacent metal grains 11. Presence of bonds 22 via oxide film 12 improves mechanical strength and insulation property. Although it is desired that the oxide films 12 of adjacent metal grains 11 are bonded throughout the grain compact 1, mechanical strength and insulation property can be improved to a reasonable extent as long as oxide films 12 of adjacent metal grains 11 are bonded partially, and this pattern is also an embodiment of the present invention. Preferably the number of bonds 22 via oxide film 12 is the same as or greater than the number of metal grains 11 contained in the grain compact 1. Also, as mentioned later, metal grains 11 may be bonded together directly (metal bonds 21) instead of via their oxide films 12. Furthermore, a pattern may be partially present where adjacent metal grains 11 do not bond together either via oxide film 12 or directly, but are only in contact with, or close to, other metal grains 11.

Methods to generate bonds 22 via oxide film 12 include, for example, applying heat treatment at the specified temperature mentioned later in an ambience of oxygen (such as air) while the grain compact 1 is manufactured.

According to the present invention, the grain compact 1 may have not only bonds via oxide film 12, but also bonds 21 via metal grains 11 (metal bonds). As with the aforementioned bonds 22 via oxide film 12, presence of bonds 21 via metal grains 11 can be clearly determined by, for example, visually confirming on a SEM observation image taken at approx. 3000 magnifications the identicalness of phase and existence of bonding points between adjacent metal grains 11. Bonds 21 via metal grains 11 improves the magnetic permeability further.

One way to produce bonds 21 via metal grains 11 is to use a material grain having less oxide film, adjust the temperature and partial pressure of oxygen of heat treatment applied when manufacturing the grain compact 1 as mentioned later, or adjust the compact density when the grain compact 1 is obtained from the material grain. For the heat treatment temperature, a level at which metal grains 11 bond together while production of oxides is suppressed can be proposed. The specific range of favorable temperatures will be described later. For the partial pressure of oxygen, it can be the same as the partial pressure of oxygen in air, for example. The lower the partial pressure of oxygen, the more the production of oxides is suppressed and consequently metal grains 11 bond together more easily.

A magnetic material constituted by the grain compact 1 thus obtained can be used as a constituent part of various electronic components. For example, a magnetic material according to the present invention can be used as a core and an insulated sheath wire can be wrapped around it to form a coil. Or, a green sheet containing the aforementioned material grain can be formed by a known method and a specified pattern can be formed on the sheet by printing or otherwise applying a conductive paste, after which multiple units of such printed green sheets can be stacked on top of each other, pressurized and then given heat treatment under the aforementioned conditions to obtain an inductor (coil component) having a coil formed in a magnetic material constituted by a grain compact as proposed by the present invention. Various other coil components can be obtained by using a magnetic material according to the present invention and forming a coil inside or on the surface of such material. Such coil components may be of surface mounting type, through-hole mounting type and various other mounting patterns, and the means for constituting the coil component of any such mounting pattern and means for obtaining the coil component from the magnetic material can incorporate any known manufacturing method used in the field of electronic components as deemed appropriate.

The present invention is explained more specifically using an example. It should be noted, however, that the present invention is not at all limited to the embodiment described in the example.

EXAMPLES (Material Grain)

A commercial Fe—Cr—Si alloy powder manufactured according to the atomization method was used as the material grain. The surface of an assembly of this alloy powder was analyzed by XPS to calculate $Fe_{Metal}/(Fe_{Metal}+Fe_{Oxide})$ mentioned earlier. The composition of alloy powder was calculated using the ZAF method by conducting an energy dispersive X-ray spectroscopy (EDS). The alloy powder's d10, d50 and d90, each being a grain size distribution indicator based on volume, were measured using a laser diffraction/scattering measurement apparatus. The tap density of the alloy powder was measured according to the JIS Z 2512: 2006 standard. The commercial alloy powder was used directly as the material grain, or reduced or oxidized before use. The reduction treatment was implemented by holding the alloy powder in an ambience of nitrogen containing 30% hydrogen at a temperature of 800° for 1 hour, while the oxidization treatment was implemented by holding the alloy powder in air at a temperature of 500° for 1 hour.

The above indicators of the alloy powder are shown in Table 1 below. Here, "Fe ratio" represents the calculated value of $Fe_{Metal}/(Fe_{Metal}+Fe_{Oxide})$. Sample No. 19 is a comparative example because its calculated value of $Fe_{Metal}/(Fe_{Metal}+Fe_{Oxide})$ is small (this sample is denoted by * in the table). In the table, in the column of "Pre-processing", "RT" and "OT" represent "Reduction treatment" and "Oxidization treatment", respectively.

TABLE 1

| | Composition (wt %) | | | D50 | d10/ | d90/ | Pre-pro- | Fe | Tap density |
|---|---|---|---|---|---|---|---|---|---|
| No. | Fe | Si | Cr | [μm] | d50 | d50 | cessing | ratio | [g/cm³] |
| 1 | 96.9 | 3.0 | 0.1 | 9.5 | 0.42 | 2.30 | RT | 0.25 | 4.10 |
| 2 | 95 | 3.0 | 2.0 | 9.6 | 0.41 | 2.24 | None | 0.22 | 4.10 |
| 3 | 92 | 3.5 | 4.5 | 9.6 | 0.41 | 2.24 | None | 0.25 | 4.12 |
| 4 | 87 | 3.5 | 9.5 | 10.6 | 0.37 | 2.46 | OT | 0.24 | 4.09 |
| 5 | 82 | 3.0 | 15.0 | 9.7 | 0.40 | 2.30 | None | 0.27 | 4.20 |
| 6 | 82 | 0.0 | 18.0 | 10.1 | 0.40 | 2.25 | OT | 0.23 | 4.05 |
| 7 | 92 | 3.5 | 4.5 | 5.0 | 0.47 | 2.04 | None | 0.23 | 3.81 |
| 8 | 92 | 3.5 | 4.5 | 9.7 | 0.05 | 3.61 | None | 0.24 | 4.17 |
| 9 | 92 | 3.5 | 4.5 | 9.5 | 0.10 | 3.55 | None | 0.21 | 4.22 |
| 10 | 92 | 3.5 | 4.5 | 9.6 | 0.20 | 3.10 | None | 0.26 | 4.21 |
| 11 | 92 | 3.5 | 4.5 | 9.6 | 0.65 | 1.91 | None | 0.25 | 4.05 |
| 12 | 92 | 3.5 | 4.5 | 9.7 | 0.70 | 1.89 | None | 0.24 | 3.98 |
| 13 | 92 | 3.5 | 4.5 | 9.5 | 0.75 | 2.10 | None | 0.22 | 3.95 |
| 14 | 92 | 3.5 | 4.5 | 9.6 | 0.51 | 1.20 | None | 0.25 | 4.01 |
| 15 | 92 | 3.5 | 4.5 | 9.4 | 0.55 | 1.40 | None | 0.25 | 4.06 |
| 16 | 92 | 3.5 | 4.5 | 9.8 | 0.44 | 4.50 | None | 0.24 | 4.10 |
| 17 | 92 | 3.5 | 4.5 | 9.7 | 0.15 | 5.00 | None | 0.24 | 4.40 |
| 18 | 92 | 3.5 | 4.5 | 9.6 | 0.25 | 6.10 | None | 0.24 | 4.20 |
| 19(*) | 92 | 3.5 | 4.5 | 9.6 | 0.41 | 2.24 | OT | 0.15 | 4.08 |
| 20 | 92 | 3.5 | 4.5 | 9.6 | 0.38 | 2.20 | None | 0.20 | 4.10 |
| 21 | 92 | 3.5 | 4.5 | 9.6 | 0.41 | 2.24 | RT | 0.29 | 4.12 |
| 22 | 92 | 3.5 | 4.5 | 9.6 | 0.41 | 2.24 | RT | 0.60 | 4.12 |
| 23 | 92 | 3.5 | 4.5 | 9.4 | 0.51 | 1.85 | None | 0.23 | 3.50 |
| 24 | 92 | 3.5 | 4.5 | 9.6 | 0.55 | 2.01 | None | 0.24 | 3.80 |
| 25 | 92 | 3.5 | 4.5 | 9.6 | 0.33 | 3.05 | None | 0.24 | 4.35 |
| 26 | 92 | 3.5 | 4.5 | 10.1 | 0.19 | 3.41 | None | 0.25 | 4.70 |
| 27 | 92 | 3.5 | 4.5 | 9.7 | 0.17 | 3.64 | None | 0.23 | 5.00 |

TABLE 1-continued

| No. | Composition (wt %) Fe | Si | Cr | D50 [μm] | d10/d50 | d90/d50 | Pre-processing | Fe ratio | Tap density [g/cm³] |
|---|---|---|---|---|---|---|---|---|---|
| 28 | 92 | 3.5 | 4.5 | 9.8 | 0.15 | 4.20 | None | 0.25 | 5.70 |
| 29 | 92 | 3.5 | 4.5 | 9.6 | 0.41 | 2.24 | None | 0.25 | 4.12 |
| 30 | 92 | 3.5 | 4.5 | 9.6 | 0.41 | 2.24 | None | 0.25 | 4.12 |
| 31 | 92 | 3.5 | 4.5 | 9.6 | 0.41 | 2.24 | None | 0.25 | 4.12 |
| 32 | 92 | 3.5 | 4.5 | 9.6 | 0.41 | 2.24 | None | 0.25 | 4.12 |

(Manufacturing of Grain Compact)

One hundred parts by weight of these material grains and 1.5 parts by weight of a PVA binder whose thermal decomposition temperature is 300° were mixed under agitation, to which 0.2 parts by weight of Zn stearate was added as a lubricant. Thereafter, the mixture was shaped to a specified shape at 25° under the pressure shown in Table 2, and then given heat treatment in an ambience of 21% oxygen concentration at the temperature shown in Table 2 for 1 hour, to obtain a grain compact. This grain compact was measured for magnetic permeability before and after heat treatment. The specific resistance of the grain compact was also measured. The shaping conditions and measurement results are shown in Table 2. Samples whose $Fe_{Metal}/(Fe_{Metal}+Fe_{Oxide})$ ratio was 0.2 or more demonstrated a higher magnetic permeability after heat treatment compared to the level before heat treatment, thereby achieving both a high magnetic permeability and high specific resistance after heat treatment. In the table, "SP" represents "Shaping pressure"; "HT" represents "Heat treatment temperature"; "MPBHT" represents "Magnetic permeability before heat treatment"; "MPAHT" represents "Magnetic permeability after heat treatment"; and "SRT" represents "Specific resistance treatment".

TABLE 2

| No. | SP [ton/cm³] | HT [° C.] | MPBHT | MPAHT | SRT [Ω · cm] |
|---|---|---|---|---|---|
| 1 | 8.0 | 750 | 37 | 33 | $1 \times 10^5$ |
| 2 | 8.0 | 750 | 36 | 40 | $6 \times 10^5$ |
| 3 | 8.0 | 750 | 36 | 48 | $4 \times 10^5$ |
| 4 | 8.0 | 750 | 35 | 47 | $1 \times 10^5$ |
| 5 | 8.0 | 750 | 36 | 47 | $2 \times 10^5$ |
| 6 | 8.0 | 750 | 33 | 45 | $3 \times 10^3$ |
| 7 | 8.0 | 750 | 33 | 36 | $6 \times 10^5$ |
| 8 | 8.0 | 750 | 35 | 36 | $4 \times 10^5$ |
| 9 | 8.0 | 750 | 36 | 47 | $3 \times 10^5$ |
| 10 | 8.0 | 750 | 37 | 49 | $5 \times 10^5$ |
| 11 | 8.0 | 750 | 35 | 46 | $3 \times 10^5$ |
| 12 | 8.0 | 750 | 34 | 42 | $2 \times 10^5$ |
| 13 | 8.0 | 750 | 34 | 40 | $8 \times 10^4$ |
| 14 | 8.0 | 750 | 30 | 31 | $7 \times 10^5$ |
| 15 | 8.0 | 750 | 33 | 38 | $5 \times 10^5$ |
| 16 | 8.0 | 750 | 37 | 49 | $3 \times 10^5$ |
| 17 | 8.0 | 750 | 38 | 49 | $2 \times 10^5$ |
| 18 | 8.0 | 750 | 38 | 48 | $4 \times 10^4$ |
| 19(*) | 8.0 | 750 | 28 | 30 | $1 \times 10^6$ |
| 20 | 8.0 | 750 | 36 | 46 | $3 \times 10^5$ |
| 21 | 8.0 | 750 | 36 | 60 | $1 \times 10^5$ |
| 22 | 8.0 | 750 | 36 | 63 | $1 \times 10^5$ |
| 23 | 8.0 | 750 | 30 | 33 | $2 \times 10^6$ |
| 24 | 8.0 | 750 | 35 | 47 | $4 \times 10^5$ |
| 25 | 8.0 | 750 | 38 | 49 | $2 \times 10^5$ |
| 26 | 8.0 | 750 | 39 | 49 | $1 \times 10^5$ |
| 27 | 8.0 | 750 | 39 | 49 | $1 \times 10^5$ |
| 28 | 8.0 | 750 | 39 | 49 | $1 \times 10^5$ |
| 29 | 6.0 | 750 | 32 | 38 | $7 \times 10^5$ |
| 30 | 12.0 | 750 | 39 | 50 | $2 \times 10^5$ |
| 31 | 8.0 | 650 | 36 | 37 | $1 \times 10^5$ |
| 32 | 8.0 | 850 | 36 | 42 | $5 \times 10^5$ |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. In this disclosure, any defined meanings do not necessarily exclude ordinary and customary meanings in some embodiments. Also, in this disclosure, "the invention" or "the present invention" refers to one or more of the embodiments or aspects explicitly, necessarily, or inherently disclosed herein.

The present application claims priority to Japanese Patent Application No. 2011-158437, filed Jul. 19, 2011, the disclosure of which is incorporated herein by reference in its entirety. In some embodiments, as methods for manufacturing the magnetic materials and structures thereof, those disclosed in U.S. Patent Application Publication No. 2011/0267167 A1 and No. 2012/0038449, co-assigned U.S. patent application Ser. No. 13/313,982, Ser. No. 13/313,999, and Ser. No. 13/351,078 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A method of manufacturing a magnetic material, comprising:

selecting metal grains which are made of a Fe—Cr—Si alloy and whose $Fe_{Metal}/(Fe_{Metal}+Fe_{Oxide})$ ratio as measured before shaping by XPS is 0.2 or more wherein $Fe_{Oxide}$ is the sum of integral values at peaks of 709.6 eV, 710.7 eV and 710.9 eV, and $Fe_{Metal}$ is a peak integral value at 706.9 eV; and shaping a formed body using the metal grains; and heating the formed body to obtain a grain compact as a magnetic material, wherein the step of selecting the metal grains comprises providing metal grains; measuring the $Fe_{Metal}/(Fe_{Metal}+Fe_{Oxide})$ ratio; if the ratio is not 0.2 or more, treating the metal grains with acid or with heat in a reducing ambience.

2. The method according to claim 1, wherein the step of shaping the formed body is conducted under a non-heated condition.

3. The method according to claim 1, wherein the step of shaping the formed body comprises mixing the metal grains with an organic resin as a binder.

4. The method according to claim 1, wherein the step of heating the formed body is conducted in an oxidizing ambience.

5. The method according to claim 1, wherein the step of heating the formed body is conducted under conditions such that the formation of both oxide film bond between the metal grains and metal bond between the metal grains is facilitated.

6. The method according to claim 1, wherein the Cr content in the grain compact is 2.0 to 15 percent by weight.

7. The method according to claim 1, wherein the grain size distribution of metal grains before shaping, based on volume, is such that d10/d50 is 0.1 to 0.7 and d90/d50 is 1.4 to 5.0.

8. The method according to claim 1, wherein the tap density of metal grains before shaping, as specified in the Japanese Industrial Standard (JIS) Z 2512:2006, is 3.8 g/cm$^3$ or more.

* * * * *

UNITED STATES PATENT AND TRADEMARK OFFICE

CERTIFICATE OF CORRECTION

PATENT NO. : 9,293,244 B2
APPLICATION NO. : 13/546911
DATED : March 22, 2016
INVENTOR(S) : Hitoshi Matsuura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 924 days.

Signed and Sealed this
Seventh Day of June, 2016

Michelle K. Lee

Michelle K. Lee
*Director of the United States Patent and Trademark Office*